US008453541B2

(12) United States Patent
Dagenais et al.

(10) Patent No.: US 8,453,541 B2
(45) Date of Patent: Jun. 4, 2013

(54) REDUCED WEIGHT POWER TONG FOR TURNING PIPE

(75) Inventors: Dan Dagenais, Edmonton (CA); Murray Gerwing, Edmonton (CA); Steven Hargreaves, St. Albert (CA)

(73) Assignee: McCoy Corporation, Edmonton (CA)

( * ) Notice: Subject to any disclaimer, the term of this patent is extended or adjusted under 35 U.S.C. 154(b) by 144 days.

(21) Appl. No.: 12/990,266

(22) PCT Filed: Apr. 29, 2009

(86) PCT No.: PCT/CA2009/000548

§ 371 (c)(1), (2), (4) Date: Oct. 29, 2010

(87) PCT Pub. No.: WO2009/132428

PCT Pub. Date: Nov. 5, 2009

(65) Prior Publication Data

US 2011/0041656 A1 Feb. 24, 2011

Related U.S. Application Data

(60) Provisional application No. 61/049,174, filed on Apr. 30, 2008.

(51) Int. Cl.
*B25B 21/00* (2006.01)
*B25B 13/50* (2006.01)

(52) U.S. Cl.
USPC ..... 81/57.18; 81/57.15

(58) Field of Classification Search
USPC ..... 81/57.14, 57.15, 57.18, 57.2
See application file for complete search history.

(56) References Cited

U.S. PATENT DOCUMENTS

| | | | |
|---|---|---|---|
| 2,846,909 | A | 7/1958 | Mason |
| 3,023,651 | A | 3/1962 | Wallace |
| 3,180,186 | A | 4/1965 | Catland |
| 3,261,241 | A | 7/1966 | Catland |

(Continued)

FOREIGN PATENT DOCUMENTS

| | | |
|---|---|---|
| CA | 2012683 | 9/1990 |
| CA | 1327825 | 3/1994 |

(Continued)

OTHER PUBLICATIONS www.eckel.com/manufacturing.html.

(Continued)

*Primary Examiner* — David B Thomas
(74) *Attorney, Agent, or Firm* — Field LLP

(57) ABSTRACT

A power tong body having a central opening comprises upper and lower cover plates and a rotary gear contained there between. The tong incorporates the centering guide, e.g. rollers, that extend between the rotary gear and respective tong covers. Such centering guides through the central openings in the tong body covers and provide contact surfaces carried that permit differential rotation of the rotary gear with respect to such covers. The rollers may roll on circular races formed by the inside edge face surfaces of the tong covers bordering the central opening. The support rollers may also extend beyond the upper and lower cover plates and engage with a guide surface or race formed on the respective cage plates of the tong, centrally locating such cage plates with respect to the rotary gear while allowing differential rotation of the cage plates with respect to the rotary gear.

17 Claims, 12 Drawing Sheets

U.S. PATENT DOCUMENTS

| | | | | |
|---|---|---|---|---|
| 3,371,562 | A * | 3/1968 | Kelley | 81/57.18 |
| 3,691,875 | A | 9/1972 | Geczy et al. | |
| 4,084,453 | A | 4/1978 | Eckel | |
| 4,089,240 | A | 5/1978 | Eckel | |
| 4,246,809 | A | 1/1981 | Keast et al. | |
| 4,250,773 | A | 2/1981 | Haynes | |
| 4,266,450 | A | 5/1981 | Farr et al. | |
| 4,273,010 | A | 6/1981 | Farr | |
| 4,290,304 | A | 9/1981 | Eckel | |
| 4,334,444 | A * | 6/1982 | Carstensen et al. | 81/57.18 |
| 4,346,629 | A | 8/1982 | Kinzbach | |
| 4,350,062 | A | 9/1982 | Farr et al. | |
| 4,372,026 | A | 2/1983 | Mosing | |
| 4,401,000 | A | 8/1983 | Kinzbach | |
| 4,404,876 | A | 9/1983 | Eckel | |
| 4,445,402 | A | 5/1984 | Farr et al. | |
| RE31,699 | E | 10/1984 | Eckel | |
| 4,487,092 | A | 12/1984 | Neves | |
| 4,827,808 | A | 5/1989 | Haynes | |
| 5,044,232 | A | 9/1991 | Schulze-Beckinghausen | |
| 5,144,868 | A | 9/1992 | Feigel | |
| 5,394,774 | A | 3/1995 | Dlask | |
| 5,435,213 | A | 7/1995 | Buck | |
| 5,819,604 | A | 10/1998 | Buck | |
| 5,819,605 | A | 10/1998 | Buck et al. | |
| 5,904,075 | A * | 5/1999 | Buck | 81/57.18 |
| 6,082,224 | A | 7/2000 | McDaniels | |
| 6,279,426 | B1 | 8/2001 | Neves | |
| 6,327,938 | B1 | 12/2001 | Pietras | |
| 6,619,160 | B1 | 9/2003 | Buck et al. | |
| 6,988,428 | B1 | 1/2006 | Kathan | |
| 6,990,876 | B2 | 1/2006 | Mardian | |
| 7,219,580 | B2 | 5/2007 | Dagenais | |
| 7,255,025 | B2 | 8/2007 | Dagenais | |
| 7,717,014 | B2 * | 5/2010 | Carstensen | 81/57.18 |
| 7,882,767 | B2 * | 2/2011 | Musemeche | 81/57.15 |
| 2002/0144575 | A1 | 10/2002 | Niven | |
| 2003/0177870 | A1 | 9/2003 | Neves | |
| 2005/0097993 | A1 | 5/2005 | Niven | |
| 2005/0160881 | A1 | 7/2005 | Niven | |
| 2008/0022811 | A1 | 1/2008 | Kathan | |

FOREIGN PATENT DOCUMENTS

| | | |
|---|---|---|
| CA | 2268058 | 4/1998 |
| CA | 2204214 | 11/1998 |
| CA | 2413544 | 1/2002 |
| CA | 2564084 | 11/2005 |
| CA | 2512171 | 1/2006 |
| DE | 3321358 | 12/1984 |
| KR | 20030021062 | 3/2003 |
| WO | 2005/110682 | 11/2005 |

OTHER PUBLICATIONS www.mightymitetongs.ca.

* cited by examiner

REDUCED WEIGHT POWER TONG FOR TURNING PIPE

FIELD OF THE INVENTION

This invention relates to power tongs for use in rotating drilling pipe and the like for the oil well industry as well as any other application where a pipe or cylindrical member has to be gripped. More particularly, it relates to a tong which is of improved construction.

BACKGROUND TO THE INVENTION

In the field of oil well drilling technology, power tongs are used to turn and make-up or break joints on tubing or drill rod as small as on the order of 1 inches in diameter, and on pipe or casing ranging up to 16 inches in diameter or more. Hereafter in this specification, all such tubing and rod whether for use in the oilfield or otherwise are collectively referred to as "pipe".

As an example of a power tong of the type which may be re-adapted to employ the invention herein, reference may be made to U.S. Pat. No. 4,350,062, to Fan et al. This patent describes a power tong having a "C"-shaped power-driven rotary gear which turns within an outwardly containing tong body. The gap in the "C" serves as a throat through which pipe may be passed into the central body region of the tong.

The tong body also is "C"-shaped to allow pipe to be centered within the tong for rotation. While reference will be made to a "C"-shaped power tong in this disclosure, the invention is equally applicable to tongs that have a closed circular central opening through which pipe is inserted endwise.

The rotary gear within the tong body of a power tong has an inwardly-directed camming surface formed along its inner circular face. This cam surface generally provides two or more inwardly extending crescent-shaped circular wedge portions intended to help the gripping jaws engage with the pipe. The jaws are carried within a respective jaw carrier that includes a cam follower roller which rides along the cam surface, forcing the jaws inwardly until pipe is engaged. The outer circumference of the rotary gear contains gear teeth for engagement with a drive train mounted within the tong body to effect rotation of rotary gear, jaws and engaged pipe.

In operation the rotary gear drives one or more jaws carried in respective jaw assemblies, through the cam follower roller, into engagement with centrally-positioned pipe as the rotary gear begins to turn with respect to the tong body. The jaws within the jaw assemblies are contained between cage plates that cap the upper and lower sides of the central opening in the rotary gear. These cage plates "float" on the outer upper and lower surfaces of the tong body, free for partial rotation with respect to the rotary gear about their common center. The outer circumferential edges of the cage plates traditionally overlie the edges of the upper and lower plates of the tong body surrounding the central opening and the cage plates are free to rotate with respect to the tong body. They are constrained to remain centered but are free to rotate about the same axis as the pipe, but only for a portion of a full revolution with respect to the rotary gear until the jaw or jaws have engaged pipe. Thereafter the cage plates and jaw carrier or carriers and associated jaws rotate with the rotary gear. The camming surface and jaw carrier dimensions are selected to ensure pipe engagement and limit differential rotation between the cage plates and the rotary gear, generally to within less than a quarter-circle of rotation.

When the rotary gear first begins to turn after pipe has been placed in the center of the tong, a brake temporarily constrains the cage plates from rotating in conjunction with the gear. As the rotary gear commences to turn, the cam followers on the jaw assemblies are advanced radially inward by the camming surfaces of the rotary gear. This inward advancement arising from differential rotation between the cage plates with their jaws and the rotary gear continues until the jaws engage with the drill pipe. Further advancement of the cam followers up the inwardly advancing cam surfaces locks the jaws to the pipe and arrests further relative rotation between the cage plates and the rotary gear. Thereafter, the pipe is turned by the continued rotation of the rotary gear and jaw assemblies together, the force to effect rotation being transmitted through the jaws which are engaged with the pipe.

When the jaws are not in use, each jaw may be withdrawn from the central portion of the tong by the "parking" of each of the cam follower's rollers into a respective neutral recess formed in the inside surface of the rotary gear. Each such neutral recess is located adjacent to a beginning portion of the camming surface so that a cam follower's roller may retire into and nest within it. This allows the jaws to swing outwardly from the tong centre and frees the pipe to be slid inwardly or outwardly, through the throat in the "C"-shaped tong body, or to be inserted centrally in the case of a closed tong body.

The proper grasping of the drill pipe by the jaws depends on the relative rate of advancement of the jaws inwardly as the cam follower moves along the cam surface. The cam surface may be envisaged as a kind of curved wedge that is forced against the cam follower roller to urge the associated jaw inwards toward the pipe to is be gripped. As with a wedge, the rate of increase of the inward gripping force applied by the jaws as the cam follower moves up the cam surface will depend upon the steepness of the cam surface. This relative incline ratio of the cam surface may be characterized as the "camming schedule".

Once the jaws have contacted the pipe, a relatively high radial force is applied to the pipe in order to ensure that a non-slipping, frictional engagement persists while torque is applied to the pipe. High torque forces are required to be applied to pipe in order to ensure that the joints in the drill pipe are properly made up, to break such joints, and to turn the drill pipe string where the boring of the earth is occurring if the power tong is used for such purpose. Such torque is applied to the rotary gear through a gear train that is typically driven by a hydraulic motor mounted on the tong body.

High radial forces are achieved by providing an appropriately powered hydraulic motor and gear train. As the camming surface is generally provided with a gradual inwardly-directed slope along which the camming roller is required to advance, as the jaws engage the pipe and are urged to force rotation of the pipe, a substantial spreading force is applied to the rotary gear along its inner camming surfaces. This outwardly directed force has to be contained. At the same time, it is important to ensure that the rotary gear continues to be free to rotate within the power tong body in engagement with the powered gear train. In particular, the rotary gear should be confined centrally within the power tong for rotation about the center of the central opening in the power tong throughout these actions.

Radial Containment of the Rotary Gear

Over a considerable range of torque values, the rotary gear of a power tong can be made sufficiently robust to resist outward expansion on its own. Nevertheless, a rotary gear needs to be constrained for rotation about a central location within the power tong body. For this reason, peripheral containment or rotary gear support rollers have traditionally been provided within the tong body.

In the past, to provide radial confinement for the rotary gear roller bearings have been provided that are mounted between the top and bottom covers of the tong body. Such roller bearings have in many cases been rotatably mounted within openings drilled in such covers. These rotary gear support roller bearings have been "dumbbell" like in shape and generally each dumbbell has been provided with two roller portions which extend around the gear teeth and engage against respective outward-directed circular track surfaces serving as races on the respective upper and lower sides of the ring gear. Such tracks have traditionally been located just above and below the gear teeth to support the rotary gear symmetrically about a central horizontal plane. An example of such a configuration is shown in FIG. 2 of U.S. Pat. No. 5,435,213, to Buck for a "Ring gear camming member" wherein the rollers 23 "bear against and contain a smooth surface 32 on ring gear 15, providing resistance to spreading when jaw members 4 are engaged with pipe 3".

The roller bearings mounted inside the top and bottom covers of the tong body extend inwardly from the top and bottom inner surfaces of the cover plates to engage with a circular bearing surface on the rotary gear. The prior art configuration for supporting rotary gears has led to tongs of a significant thickness. Because the support rollers contact the rotary gear in pairs that embrace the centrally positioned gear teeth formed around the outer periphery of the rotary gear, such support roller pairs to take-up space between the rotary gear and the top and bottom on face plates. This increases the weight and/or cost of such tongs.

It would be desirable to establish a new configuration for supporting rotary gears which would allow a power tong to be built which is of reduced size and weight. This invention addresses that objective.

Specific Prior Art Rotary Gear Support

U.S. Pat. No. 4,827,808 to Haynes et al. issued May 9, 1989 for a "Rotor to assembly for power tong" describes a tong configuration wherein the rotary gear support rollers are mounted on the underside of the rotary gear, aligned to roll against a guide track carried by the bottom plate of the tong body. In particular, the support rollers are carried on posts or "stubs" protruding downwardly from the lower face of the rotary gear. The guide track contacted by the support rollers is fitted to the topside surface of the bottom cover of the tong body, and therefore the support rollers are located in the space between the rotary gear and the bottom cover. No portion of the rotary gear support rollers extends through the central opening defined by this bottom plate. An extension of the guide track is also carried by the gate at a location inwards from the levels of the tong covers. Additionally, this prior art reference is an example of providing a-symmetrical support for a rotary gear. The support rollers for the rotary gear as depicted are only present on the lower side of the rotary gear. Having cam followers on one side only as seen in this invention reduces the radial load carrying capacity of the rotary gear assembly and therefore limits applications but is nevertheless available as an option.

While U.S. Pat. No. 4,827,808 does describe a tong wherein a roller guide means for centering the rotary gear is mounted on the gear itself, nevertheless the thickness of the tong body of this configuration is increased by the fact that the rotary gear support rollers engage with the track fitted within the interior of the tong body, on the topside surface of the bottom cover of the tong body. This is particularly apparent in FIG. 3 of this reference which shows the extension of the guide track mounted on the inside surface bottom cover of the gate.

Central Alignment of the Cage Plates

Cage plates need to be centered on a power tong body as well. Cage plates can be centered on the tong either by guides mounted on the upper or lower covers of the tong body, or by guides provided by the rotary gear. In U.S. Pat. No. 5,819,604 to Buck, as seen in FIG. 3, rollers are fitted to the cage plates in a circumferential array. These rollers on the respective cage plates extend into receiving cavities, machined as accurate slots, formed in the top and bottom faces of the ring gear. These rollers keep the cage plates centered with respect to the rotary gear.

As an alternative to using rollers for centering the cage plate, Canadian patent 1,327,825 to McCoy et al, entitled "Track Supported Cage Plates for Power Tongs", describes a rail and track combination as a centering means for a cage plate assembly. The rail is a circular ring formed on the outside of the tong body, and the track is a groove formed on the inside surfaces of the cage plates, or conversely. As described, the rail is preferably formed of a high-impact, abrasion resistant, low-friction elastomeric polymeric material, such as polyurethane.

Some form of centering arrangement for cage plates must generally be present in a power tong of this type. The present invention also addresses this objective.

Rotary Gear Support Across the Gate

In the standard "C"-shaped power tong, support rollers for the rotary gear are mounted in the body of the tong extending around the circular opening within the tong, from one side of the tong throat to the other. Support rollers are not generally included in the gate that closes such throat. In most applications, when the rotary gear turns in such tongs there is a portion of its outside periphery, adjacent to the throat of the tong, that is unsupported.

It would be desirable to provide support for the rotary gear in this region, namely in the region of the throat of the power tong. This invention addresses that objective.

Confinement of Rotary Gear Against Vertical Displacement

While peripheral roller bearings traditionally supply support to ensure the centering of a rotary gear in the plane of the gear, a rotary gear is also normally confined against vertical displacement within the tong body. In the past rotary gears have been confined by a bearing ring carried on the inside face of one or both of the cover plates of the tong body, as for example in U.S. Pat. No. 3,261,241 to Catland, items 48, 50, FIGS. 4, 5. This present invention addresses a further way to provide confinement for the rotary gear against vertical displacement within the tong body.

Gate Latch Mechanism

In a "C"-shaped power tong provided with a gate to close the opening or throat in the power tong, it is important to ensure that the gate is properly latched and secure before commencing operation of the tong. U.S. Pat. No. 4,827,808 to Haynes et al. depicts a latch 32 in FIG. 1. U.S. Pat. No. 6,082,224 to McDaniels, et al. depicts in FIG. 1A a feature described as "Safety interlock prevents tong from operating unless properly latched".

The gate can be latched mechanically, in which circumstances it would be desirable to provide a detection mechanism to detect whether or not the gate is latched. Alternately, the latching of the gate can be effected by a power actuated latching system. In the past, such a hydraulically-based latching mechanism has relied upon hydraulic components located on the tong body adjacent to the gate or throat. This is an inconvenient location for either a power actuated latching system or a latch interlocked detection mechanism as this location makes such components vulnerable to collision with pipes and tools that may be present in the vicinity of the throat. It would be desirable to provide an arrangement by which a power actuated latching system or latching detection mechanism on a power tong is provided through components located at a more secure location.

The invention in its general form will first be described, and then its implementation in terms of specific embodiments will be detailed with reference to the accompanying drawings. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention, a power tong is provided with a tong body having upper and lower tong body covers with a central opening, preferably circular and "C"-shaped but optionally closed, formed such that the covers contain a rotary gear between them. In order to maintain alignment of the rotary gear relative to the tong body, on at least one side of the rotary gear the rotary gear is provided with support in the form of a centering guide for the rotary gear which extends between the rotary gear and a tong cover, passing at least partially through the central opening formed in the tong cover. Such centering guide comprises a contacting surface interface that permit differential rotational motion between the rotary gear and the tong, including its covers.

The centering guide for the rotary gear according to the invention may be provided symmetrically on the upper and lower sides of the rotary gear. Alternately, the centering guide of the invention may be provided on only one side of the rotary gear, and alternate centering means, e.g. traditional or other innovative centering means, may be provided on the other side.

Optionally and preferably, a portion of the centering guide may extend outwardly from the rotary gear to the outside surface of one of the tong body covers to engage with a tong cover. This rotary gear originating portion of the centering guide may be in the form of rollers mounted on the rotary gear, or in the form of a circular ledge or rail mounted on the rotary gear. The contacting surface that permits differential rotational motion between the rotary gear and the tong in such case is preferably located along the inwardly directed edge face of the tong cover where it bounds the central opening of the power tong. Alternately such contacting surface may be located outwardly from the inwardly directed edge face of the tong cover. In such case, contact will be made against a surface carried on the outside of the tong cover generally proximate or adjacent to the perimeter of the central opening. Contact may alternately be made against rollers which extend outwardly from the face of the rotary gear. In such case, the rollers provide the contacting surface interface.

Preferably, providing symmetrical support to the rotary gear, the centering guide may include rollers mounted in the rotary gear with upper and lower roller portions extending outwardly from the rotary gear to engage simultaneously with such portions carried by the respective upper and lower covers of the tong body as previously described. These rollers may each be in the form of a cylindrical roller shaft mounted into the rotary gear through a bearing interface, the upper and lower roller portions extending outwardly from the rotary gear to respectively roll on the radially inwardly directed edge faces of the upper and lower covers of the tong body that define the perimeter of the central opening, or equivalent surfaces carried by such covers. Thus such edge faces, which serve as circular races, may be extended by an additional guide rail surface fastened to the outside surface of the associated cover. Alternately, the upper and lower roller portions may roll on the additional guide rail surfaces directly.

As an alternative to providing a centering guide in the form of rollers, for certain applications it is permissible for such a centering guide to effect a sliding contact between its two cooperating portions that provide the contacting surfaces that permit differential rotational motion. Thus the centering guide can include non-rotating posts, or even a rail or ledge that slides at the contacting surface. In such cases, provision of a low friction engagement between the sliding surfaces is desirable.

Preferably, when rollers are employed that are in the form of a unitary cylindrical roller shaft having ends which extend outwardly from the upper and lower sides of the rotary gear, the rollers can be journal mounted into the rotary gear, or can be mounted into the rotary gear through roller bearings. However alternately, similar shafts may be mounted to the rotary gear as posts fitted into the rotary gear and independent rolling elements fitted onto the ends of the respective posts on the upper and lower sides of the rotary gear. Such independent rollers can be journal mounted on such posts, or can be mounted on such posts through roller bearings. If post-mounted roller bearings are used, these may be of relatively larger diameter than the diameter of the posts.

Alignment of the Cage Plates

Whether rollers fixed guides are mounted on the rotary gear, the outer end portions or outwardly projecting extensions of such centering guide portions may align with a guide surface carried by the associated cage plate to provide a cage plate interface. Thus a radially outwardly or inwardly-directed circular cage plate guide surface may be formed on or proximate to the inside peripheral edge of the adjacent cage plate for contacting with outer end portions or extensions of the centering guides projecting outwardly from the rotary gear. These end portions or extensions then serve the dual purposes of centering the cage plate with respect to the rotary gear while permitting relative rotation between the cage plate and the rotary gear. In this variant, the rotary gear is centered by its connection to a tong cover through a centering guide, and the associated cage plate is centered by the rotary gear, sharing centering elements carried by the rotary gear that cooperate with the tong cover.

Alternately, the cage plate may, itself, be centered relative to the tong body by a cage plate centering guide which extends between the cage plate and a tong cover. Such cage plate centering guide also comprises a cage plate contacting surface interface that permits differential rotational motion between the cage plate and the adjacent tong cover. In particular, the cage plate may be centered relative to the tong body by a cage plate centering guide which extends between the cage plate and the inwardly directed edge face surface of the tong cover bounding the central opening in the tong. The centering of the cage plate in this configuration occurs without reference to the centering of the rotary gear within the tong.

As stated previously, it is permissible for the purpose of centering a cage plate within the tong for the cage plates to slide on such extensions, as rotation between a cage plate and the rotary gear generally only occurs prior to engagement of the tong jaws with pipe that is to be turned at a stage when high contact forces are not being generated.

According to another variant, the cage plate can participate in centering the rotary gear. In this case, the centering guide is divided up so that a first centering guide or guide portion is provided between a tong cover and an associated cage plate; and then a second centering guide is provided between the cage plate and the rotary gear. Thus the cage plate may include rollers that bear against a contacting surface on the associated tong cover, e.g. the edge face surface around the central opening. And the cage plate may include rollers that bear against a contacting surface on the rotary tong. Alternately, the rotary gear may carry rollers that bear against the contacting surface carried by the cage plate. Such first and second centering guides, e.g. rollers, extend respectively between a cage plate and a tong cover and between a cage plate and the rotary gear. These guides may be alternately mounted so as to be interspersed between each other. Furthermore, such second centering guide may be carried entirely by a cage plate, by the rotary gear or by a combination of both.

It is permissible to arrange that ½ of the support guides, e.g. rollers, are carried by the cage plate to engage with the rotary gear, and the other ½ are carried by the cage plate to engage with the tong cover. In such case the rollers can be mounted radially on the inside faces of the cage plates in an interspersed fashion, with alternate rollers engaging the tong cover and rotary gear. The ratio of support guides carrying out these two functions need not be 1:1. In this case again, support is being provided to the rotary gear through the central opening in the tong.

A feature of the invention is that it becomes possible to provide support for the rotary gear across the width of the gap that defines the throat in the tong body. This support for the rotary gear may be achieved by providing the door or gate that closes the throat of the tong body with a track to provide the contact surface and serve as a portion of the centering guide across the width of the throat. This track aligns with the contacting surface for the portion of the centering guide that is carried by the corresponding cover of the tong body.

An advantage of the design of the invention is that the rotary gear may be nearly the same thickness as, or not much thicker than, the thickness of the rotary gear teeth formed around the periphery of the gear. The structure needed to center the rotary gear is positioned through the central opening of the power tong. This permits the construction of a tong which is thinner and therefore of reduced weight.

The invention provides a tong of reduced thickness which permits one or more of the outer covers of the tong body to be integrated with a portion of the tong body sidewall. This may be achieved by machining the cover and sidewall from a single plate. Such machining can conveniently be done on one side only of the work piece that is to form the cover plate. This also allows a shallower tong, as the stresses induced into the tong body are distributed across the entire cross section of the plate, thus avoiding load transfer through the bolts and dowels penetrating the tong cover plates.

The smaller height profile of a power tong according to the invention enables the use of a bolt-through connection between the top and bottom covers, with no welding being employed and no tapped holes for connection of top and bottom covers. Additionally, blind holes can be machined into the inside surfaces of the covers to receive the ends of rotating shafts, particularly those associated with the transmission gear train present within the power tong. This reduces the need for retention mechanisms for gears as well as reducing the potential for contamination to arise from outside sources. Furthermore, this permits gear train shafts to be serviced easily without the necessity of individually unscrewing nuts or other connectors associated with each shaft.

Confinement of Rotary Gear Against Vertical Displacement

To confine the rotary gear against vertical displacement within the tong body, low friction bearing vertical confinement "buttons" can be fitted onto the inside surfaces of the tong body covers opposite complementary sliding face surfaces on the outer face sides of the rotary gear, and vice versa. Such buttons are conveniently fastened to the rotary gear or covers simply through holes drilled into such components. This provides a simpler arrangement than the provision of a low friction bearing ring carried on the inside face of one or both of the cover plates of the tong body or on the rotary gear. Nevertheless, vertical containment of the rotary gear can be provided in the form of a continuous ring of low friction material mounted to either the rotary gear or alternately on the body plates of the tong rather than providing a series of buttons.

Gate Mounted Track

A power tong wherein the tong body is a "C"-shaped and having a throat may generally include a gate for closing the throat. In such case, a track may be incorporated into the gate for engagement with portions of the centering guide that normally would extend between the rotary gear and a tong cover. Such a track is accordingly aligned with the contacting surface for the centering guide that is carried by the corresponding cover of the tong body when the gate is in a closed position.

Gate Latch Mechanism

In order to either latch the gate on a "C"-shaped power tong, or provide a detection mechanism to detect whether or not the gate is latched, such latching of the gate or latch status detection can be effected by a remote actuator or sensor connected to the gate through an optionally spring loaded push cable that is confined laterally so that it can be retracted or advanced along its length to apply a force or effect a displacement at a distance. While described as a "push cable", such a cable can optionally transmit a force in both directions, providing a push, pull function.

An example of one cable arrangement to achieve this effect is that of "Bowden cable". Bowden cable, invented by and named after Ernest Monnington Bowden (1860 to 1904) relies on an inner flexible cable, the "push cable", confined within an outer flexible sheath. As an alternative to the use of such a sheathed cable, lateral confinement of a push cable within the power tong according to the invention may be achieved by machining a confining groove of appropriate dimension into the inner surface of one of the tong body covers where two such surfaces meet to provide a thickened wall portion for the tong. The side walls of this groove then serve the same function of the outer sheath utilized in Bowden cable. The containing surface over this groove is provided by a portion of the other cover that overlies the groove.

The foregoing summarizes the principal features of the invention and some of its optional aspects. The invention may be further understood by the description of the preferred embodiments, in conjunction with the drawings, which now follow.

Wherever ranges of values are referenced within this specification, sub-ranges therein are intended to be included within the scope of the invention unless otherwise indicated. Where characteristics are attributed to one or another variant of the invention, unless otherwise indicated, such characteristics are intended to apply to all other variants of the invention where such characteristics are appropriate or compatible with such other variants.

BRIEF DESCRIPTION OF THE DRAWINGS

FIG. 4 also shows a gate that incorporates an alignment track.

DESCRIPTION OF THE PREFERRED EMBODIMENT

Figure 1:
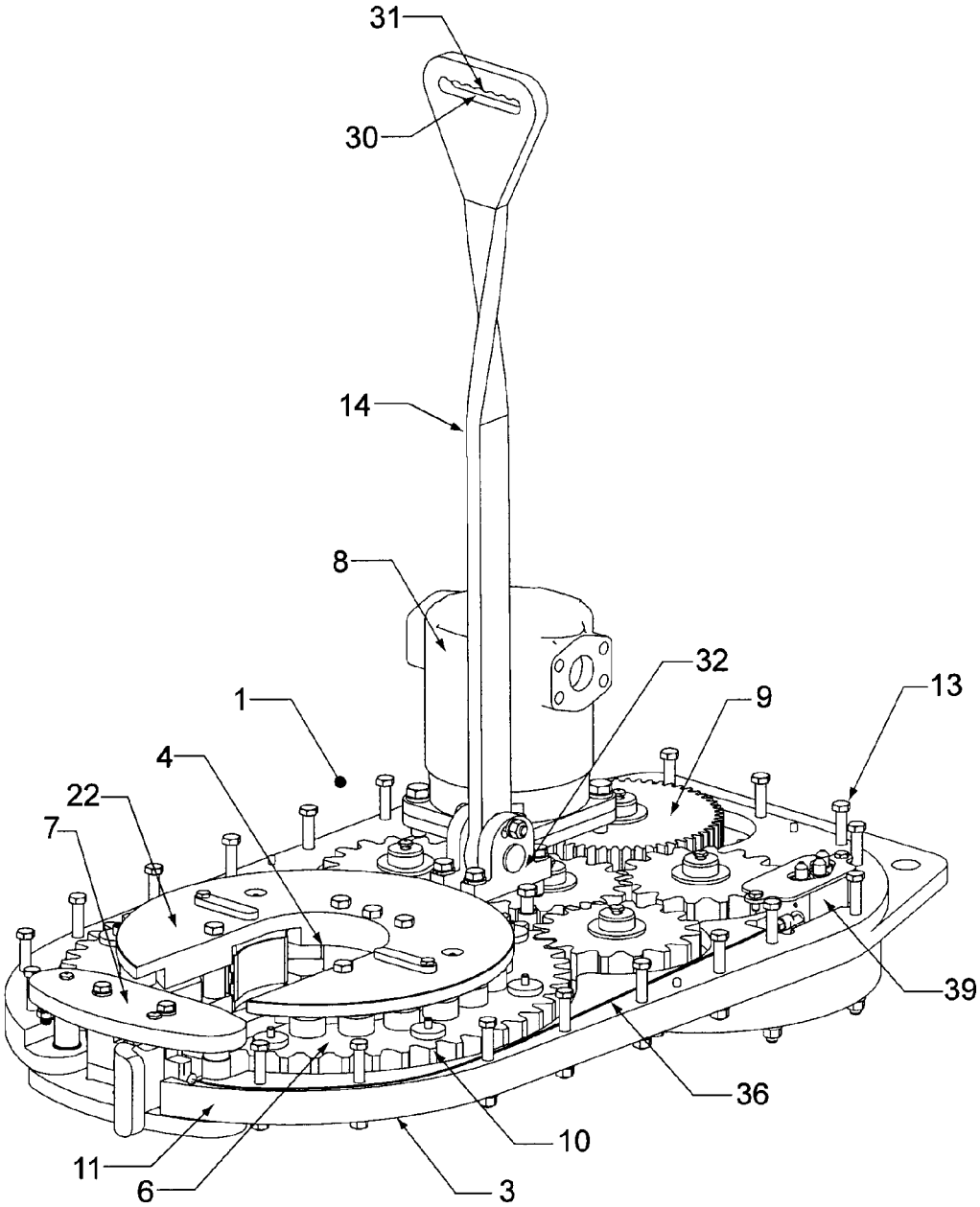
FIG. 1 is a perspective view of the power tong according to the invention with the top tong body cover removed, exposing the rotary gear and transmission gears, and with the cage plate aligned with the throat formed in the rotary gear and bottom cover of the power tong. This view shows the single hanger bar for supporting the tong.
Figure 2:
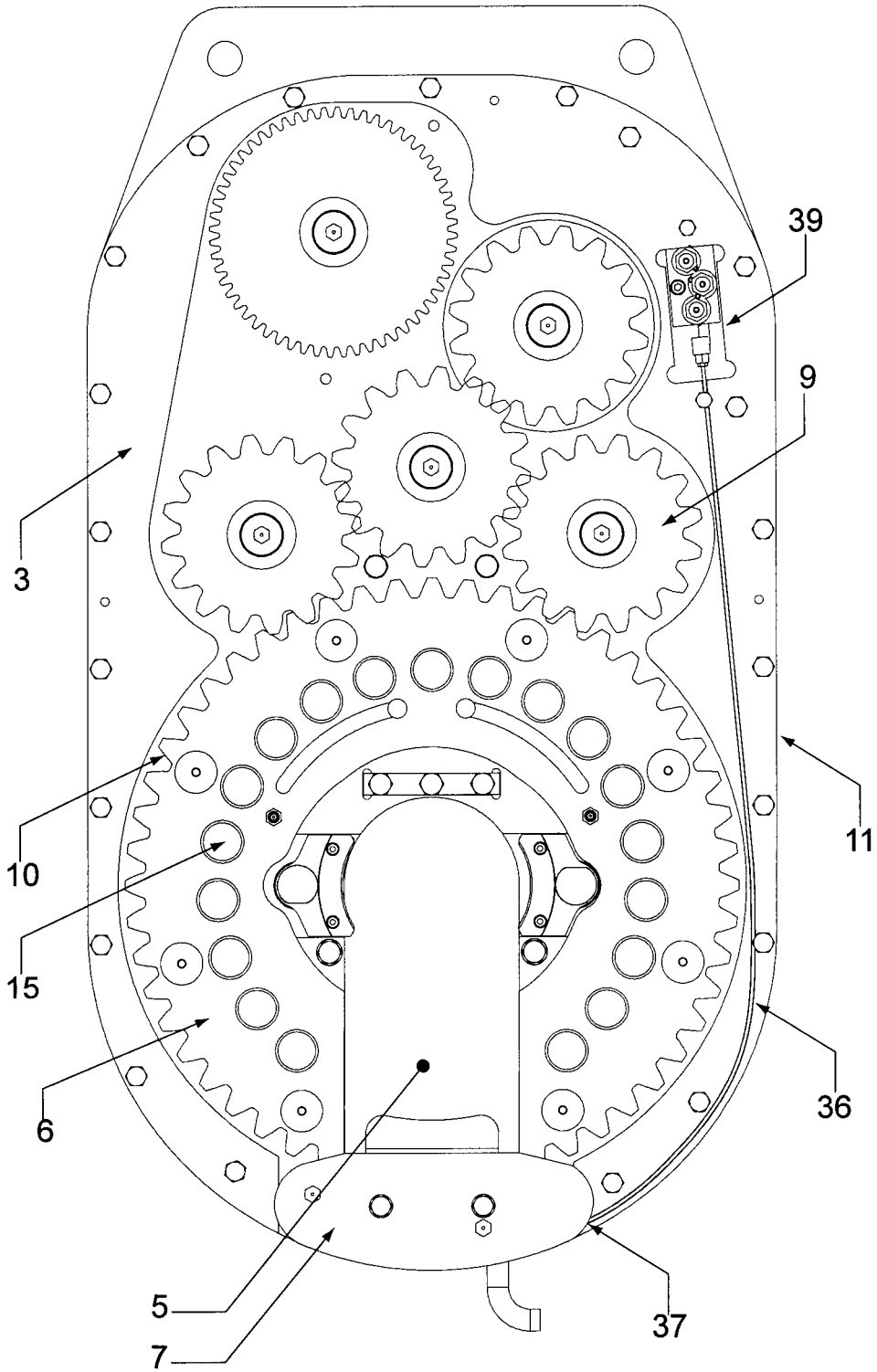
FIG. 2 is a plan view of the power tong of FIG. 1 with both the top tong body cover and the top cage plate removed exposing the rotary gear and transmission gears and with the bottom cage plate aligned with the throat formed in the bottom cover of the power tong.

In the Figures a power tong has a tong body 1 with upper 2 and lower 3 tong body covers with a central opening 4, preferably a circular "C"-shaped opening with a throat 5, formed in such covers 2, 3. The covers 2, 3 contain a rotary gear 6 between such covers 2, 3.

The tong has a gate 7 for closing the open throat, a hydraulic motor, 8 and a transmission gear train 9 extending between the hydraulic motor 8 and the rotary gear 6. The outer periphery of the rotary gear 6 is provided with gear teeth 10 which engage with corresponding gears of the transmission gear train 9.

Attached to the lower cover 2 of the tong body 1 at a point along or near a vertical line extending from its center of mass is a sling member 14. This sling member 14 is preferably in the form of a twisted or welded bar having at its upper end a transverse opening 30 extending in the direction transverse to the major length of the power tong. The upper inner boundary of the opening 30 has a series of detents 31. At its lower end, the sling member 14 is connected to the tong body 1 through a shackle member 32 providing a hinged connection having a hinge pin with a hinge axis. The series of detents 31 are aligned in a direction which is substantially parallel to such hinge axis and allow connection of the sling member 14 to a suspending chain or cable at alternate locations. This alignment of the detents 31 permits adjustment of the orientation of the tong body 1 about the longitudinal axis of the power tong.

The shackle includes two upright sidewalls that embrace the end of the supporting member. These sidewalls contain an arcuate slot that is penetrated by bolt passing through a hole in the supporting member. Adjustment of the alignment of the supporting member with the arcuate slot, followed by clamping the bolt type, will allow the orientation of the tong to be adjusted about an axis which is the same as the hinge axis.

As shown in FIGS. 1-4 the outer covers 2, 3 of the tong body 1 are integrated with the tong body sidewall 11 by being respectively machined respectively from a single plate. Bolts 13 connect the top and bottom covers 2, 3. Blind holes (not shown) are machined into the inside surfaces of the covers 2, 3 to receive the ends of shafts, particularly those associated with the transmission 9 present within the power tong body 1.

Centering of the Rotary Gear:

As shown in FIGS. 2-4A, cylindrical rollers 15 are journal mounted into the rotary gear 6 to provide alignment of the rotary gear 6 relative to the tong body 1. The outer portions of such rollers 15 at both ends bear against the respective inside edge face surfaces 16 of the top and bottom cover plates 2 and 3 surrounding the central opening 4 to provide a centering guide for the rotary gear 6. Thus such rollers 15 extend on their upper portions through the central opening 4 outwardly past the inside surface of the top cover 2.

Figure 8:
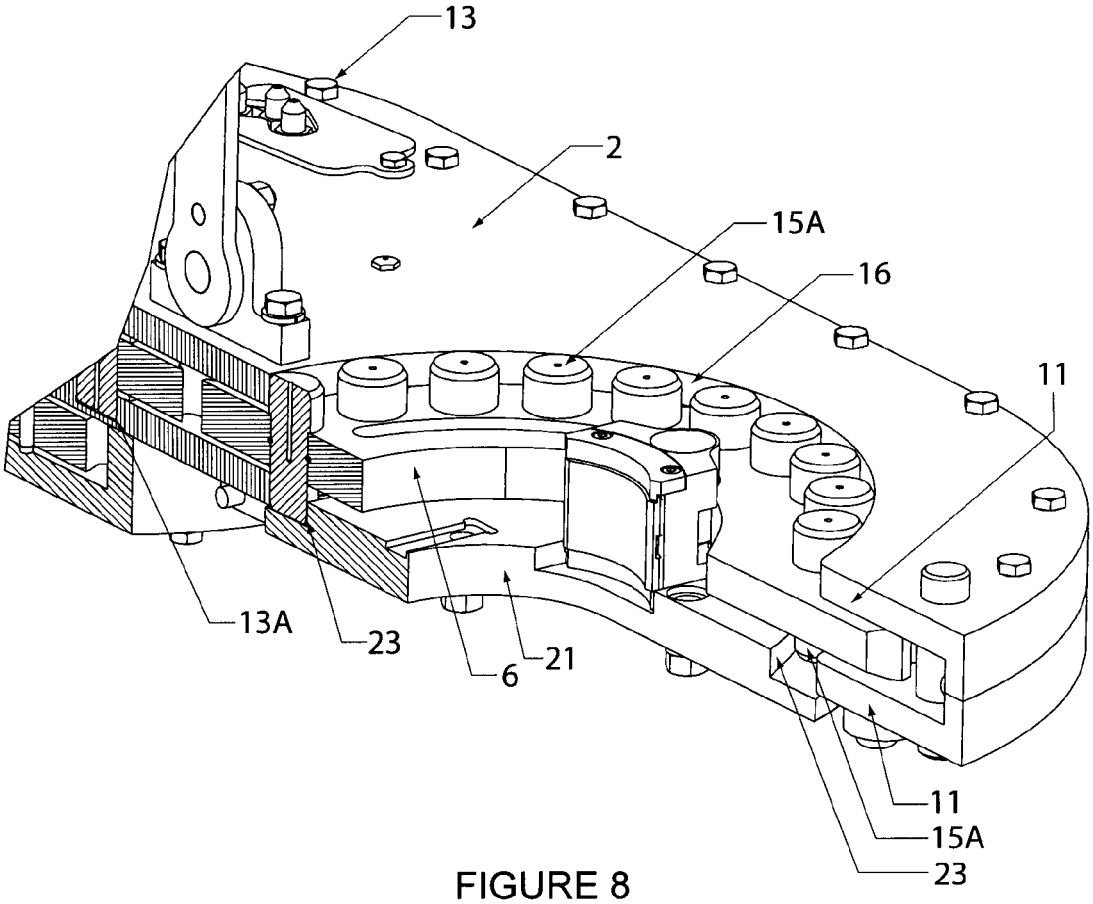
FIG. 8 is a cross-sectional perspective view through the center of a power tong as in FIG. 1 showing rollers mounted on the rotary gear bearing against the inside edge face of the circular opening formed in the top cover plate.

In FIG. 8 separate rollers 15A are mounted on pins passing outwardly from the rotary gear 6 to engage with the edge face 16 of the top and bottom cover 3. Such rollers 15A are mounted to the pins through roller bearings.

Figure 9:
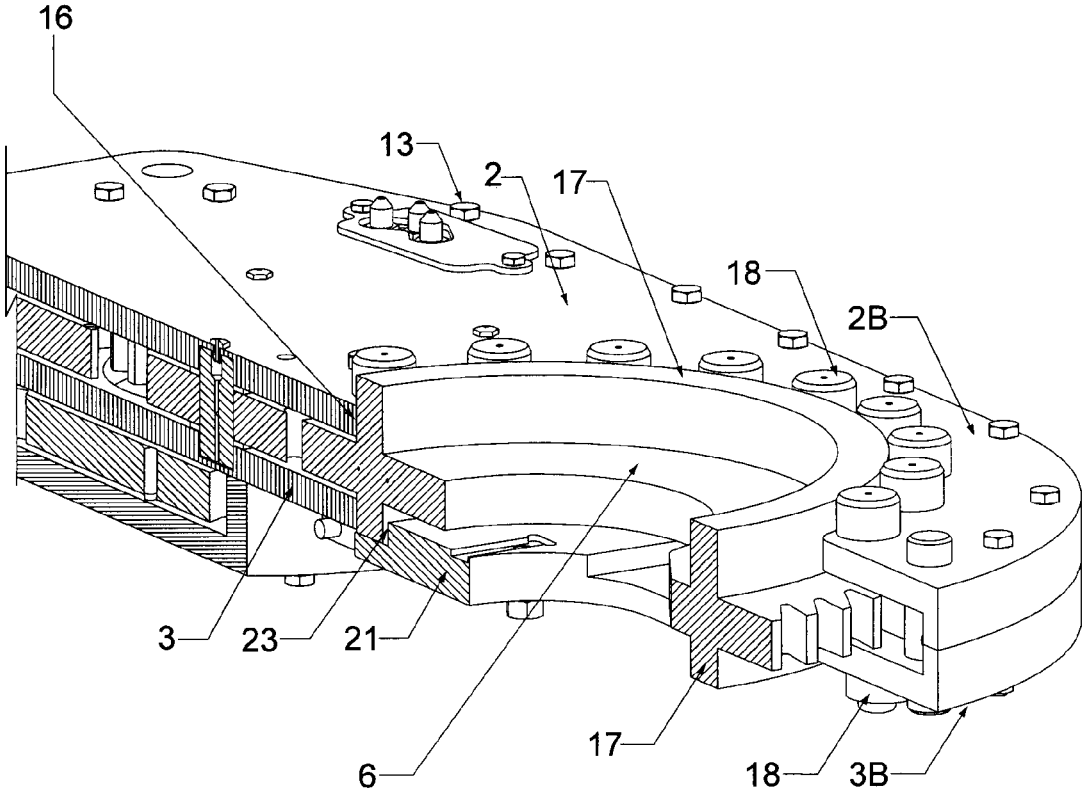
FIG. 9 is a cross-sectional view as in FIG. 8 wherein the rollers have been replaced by rails which are formed as unitary extensions of the rotary gear and which rails bear against rollers mounted on the outside covers of the power tong.

In FIG. 9 the rollers 15, 15A are replaced by two circular rails 17 extending upwardly and downwardly from the ring gear 6 to engage with cover-mounted rollers 18 positioned on the outside surface 2B, 3B of the top and bottom cover plates 2 and 3. In FIG. 9 the rails 17 are unitary portions of the ring gear 6.

Figure 10:
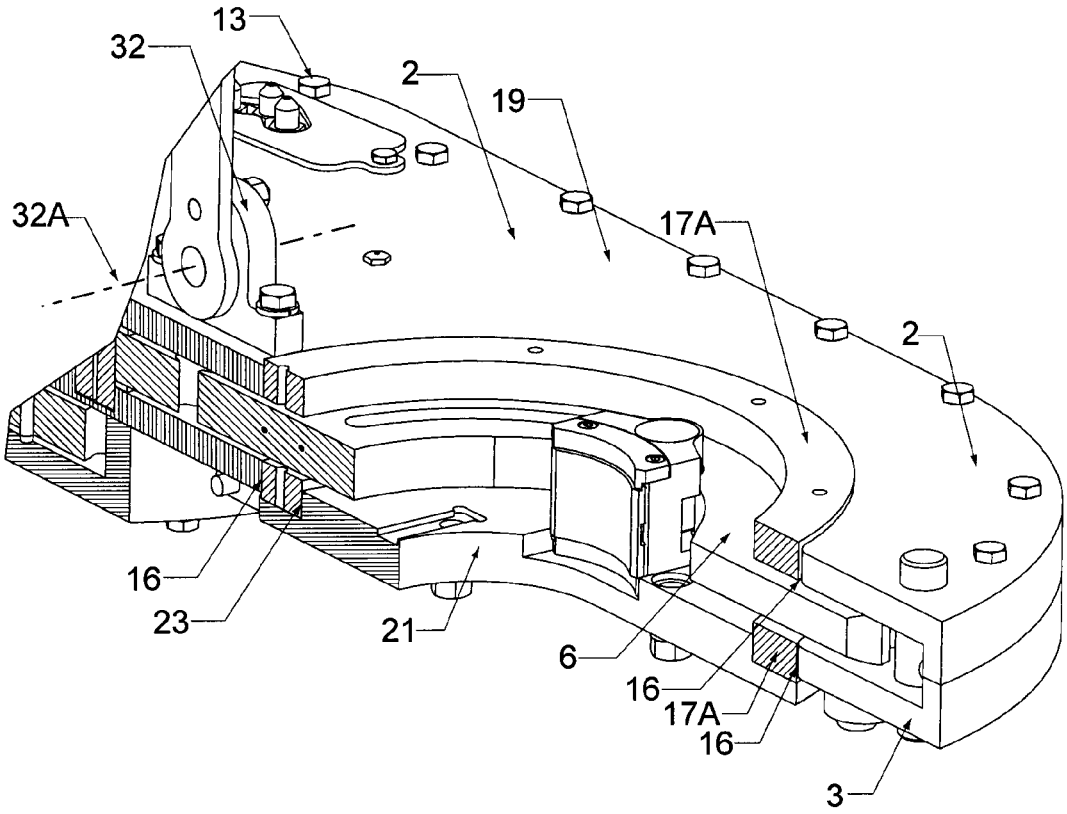
FIG. 10 is a cross-sectional view as in FIG. 9 wherein the unitary rails have been replaced by rails which are fastened to the rotary gear.

In FIG. 10 a pair of alternate circular rails 17A are fastened, as by being bolted, to the rotary gear 6. These circular rails 17A bear against the inside edge face surfaces 16 of the top and bottom covers 2, 3 along a sliding interface which serves as the contact surface.

Figure 11:
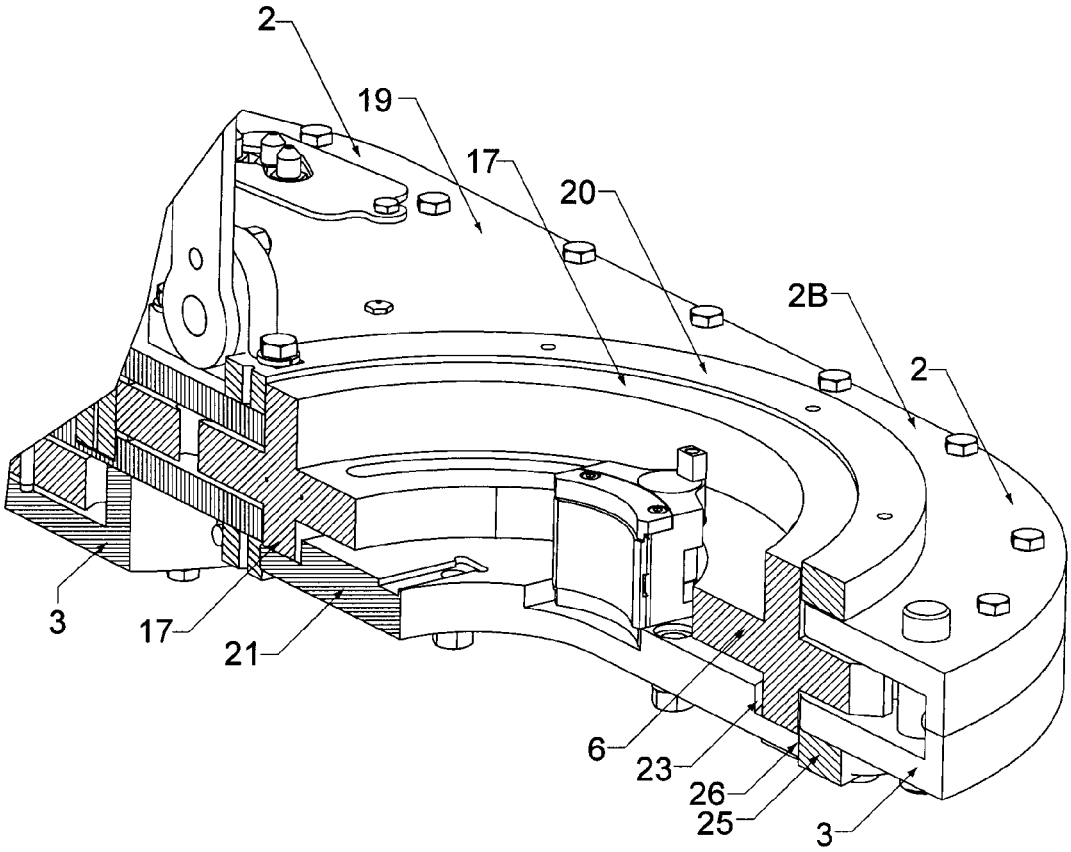
FIG. 11 is a cross-sectional view as in FIG. 9 wherein the upper rail bears against an outer guide fastened to the top face of the cover plate which serves as an extension of our alternative to the edge face surface of such cover plate to provided radial containment of the rotary gear.

In FIG. 11 the upper of the two unitary circular rails 17 extends upwardly beyond the outside surface of the upper cover 2 to engage with a cover-mounted guide 20 positioned on the outside top surface 2B of the top cover 2. While only a single upper guide 20 is shown in FIG. 11, a second lower guide 25 for the rotary gear 6 may be provided on the outside face of the lower cover 3, with suitable alternate centering structure provided for the lower cage plate 21.

Figure 4A:
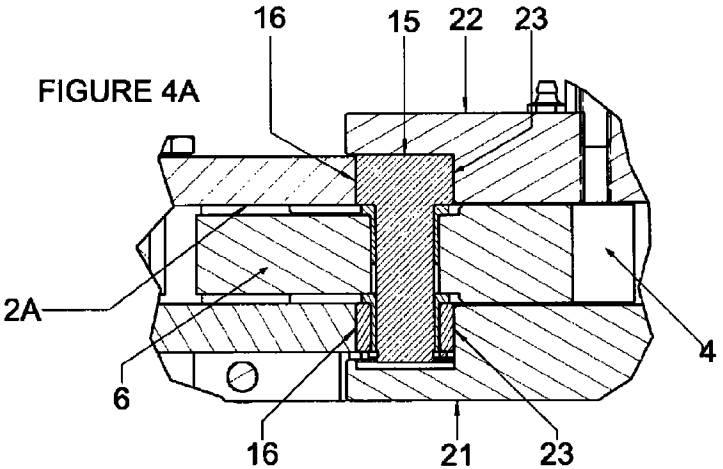
FIG. 4A is a longitudinal cross-sectional enlarged view taken through a roller of the power tong of FIG. 3.
Figure 4:
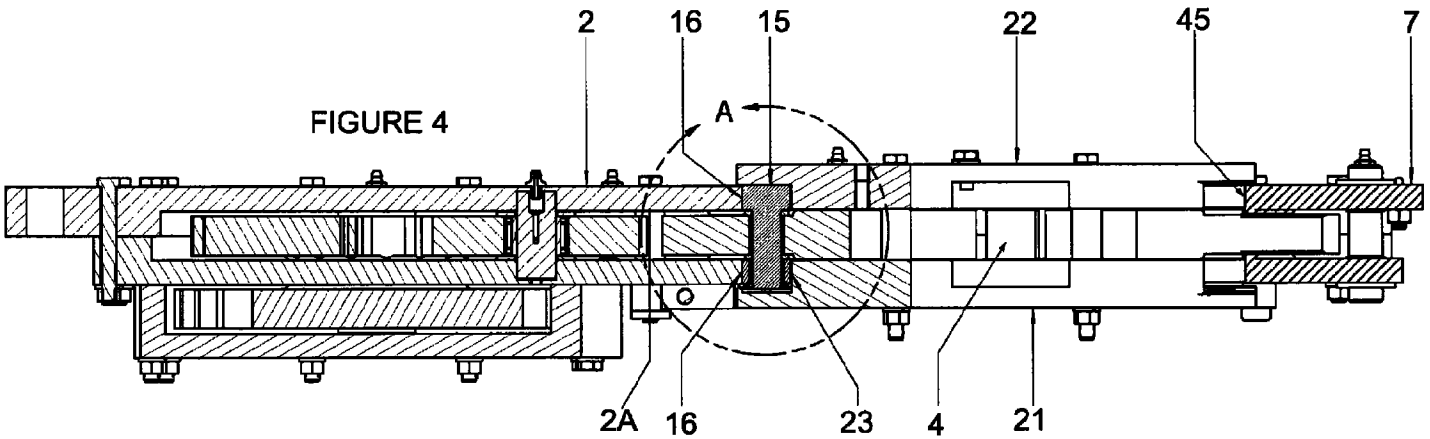
FIG. 4 is a longitudinal cross-sectional view taken along the centerline of the power tong of FIG. 3.
Figure 5:
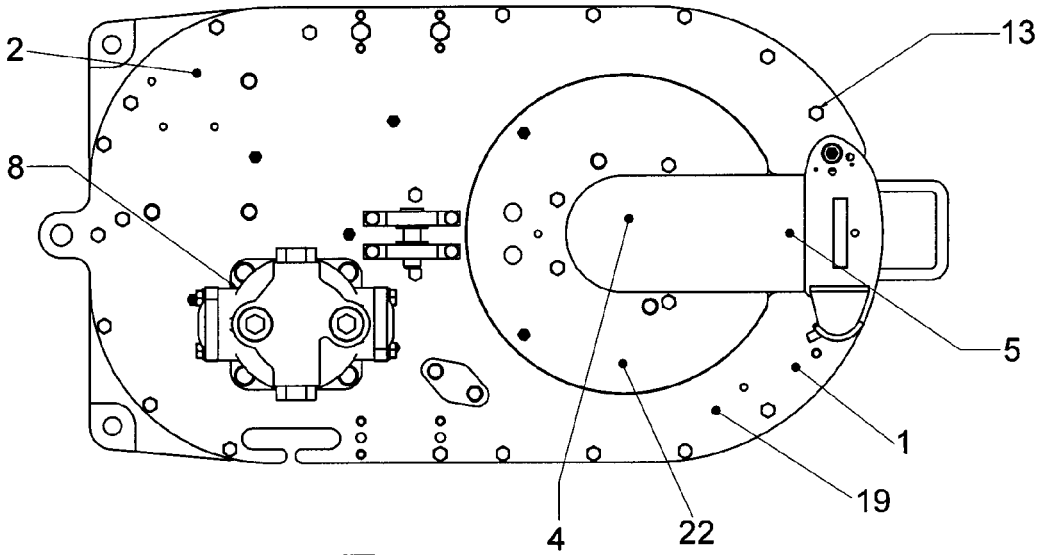
FIG. 5 is a top view of the power tong of FIG. 1 with the top tong body cover and top cage plate both present.
Figure 6:
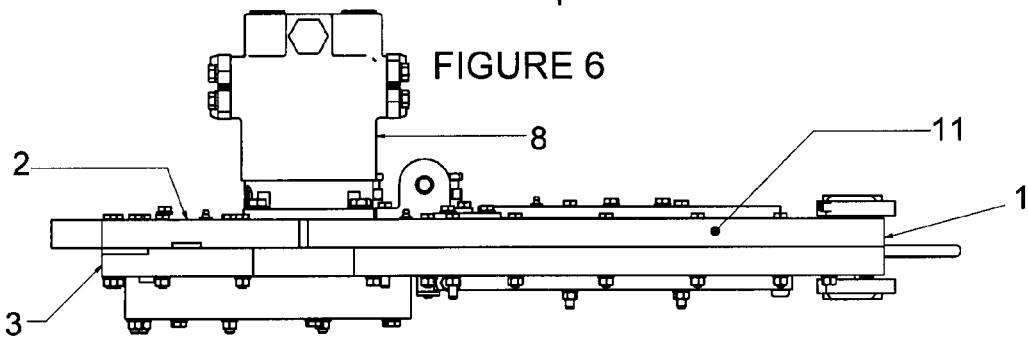
FIG. 6 is a side view of the power tong of FIG. 5.
Figure 7:
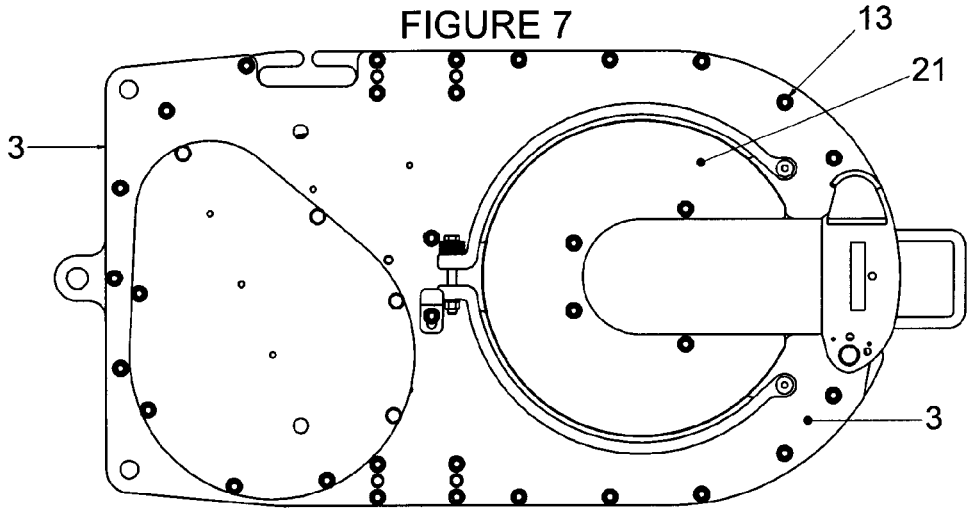
FIG. 7 if is a bottom view of the power tong of FIG. 5.

FIG. 4 shows a gate 7 closing the throat 5 of a "C"-shaped power tong. A track 45 is incorporated into the gate 7 for engagement with portions of the centering guide, e.g. rollers 15, 15A that normally would extend between the rotary gear 6 and a tong cover 2, 3. Such a track 45 is aligned with the contacting surface 16 for the centering guide that is carried by the corresponding cover 2, 3 of the tong body 1 when the gate 7 is in a closed position.

Alignment of the Cage Plates

Upper and lower cage plates 22, 21 are maintained in central alignment with the tong body 1 as shown in FIGS. 4 and 8 by contact between a radially outwardly directed circumferential surface 23 forming part of a centering track on the cage plates 21, 22, and the outwardly extending portions of the rollers 15, 15A. In FIG. 9 the rail 17 is shown contacting such a circumferential surface 23 on the lower cage plate 21.

In FIG. 10, the alternate rail 17A contacts the radially outwardly directed circumferential surface 23 of the cage plates 22 & 21 as well as the inwardly directed edge face surface 16 in the cover plate 2, 3.

In FIG. 11 containment of the lower cage plate 21 is provided by contact between the cage plate surface 23 and the lower rail 17 of the rotary gear 6, supplemented by a lower cover-mounted guide 25 positioned opposite the outer peripheral edge 26 of the lower cage plate 21. The rail 17 in FIG. 11 is shown as being a-symmetrical between its top and bottom portions. A cage plate mounted on the top (not shown), would not be confined by a supplementary cover-mounted guide in this configuration.

A differential "sliding" (rather than rolling) of the centering guide contacting surfaces on the cage plates 21,22 over or against rollers 15, 15A that rotate in order to support the rotary gear 6 is acceptable under many applications. In such case the cage plates 21, 22 may be said to be maintained in a "floating" confinement by sliding against the rollers 15, 15A. While not ideal, when the highest torques are being transmitted to the rotary gear 6 virtually no differential motion occurs between the rotary gear 6 and the cage plates 21, 22. When the rotary gear's requirement for support is greatest (high static loads), no significant differential movement in the chain of parts delivering the force e.g. no rolling, occurs. Where "skidding" at the contacting surfaces does occur, it is preferable to provide enough clearance between the parts to prevent scoring or jamming.

Cage Plates Support for the Rotary Gear

Figure 14:
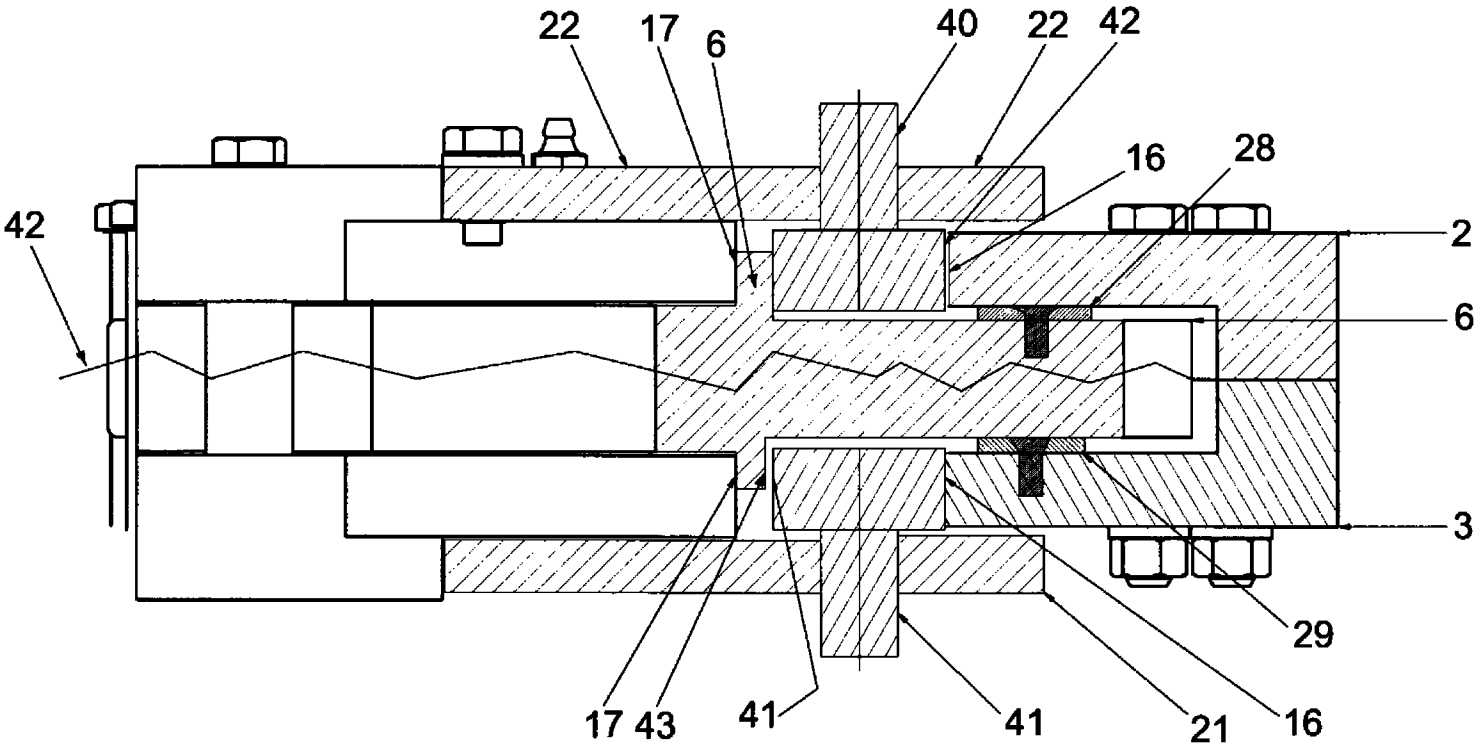
FIG. 14 is a radial, vertical cross-sectional view taken through two alternate roller configurations for rollers carried respectively by the upper and lower cage plates. The upper roller contacts the rotary gear and the lower roller contacts the adjacent surface of the lower cover plate.

In FIG. 14 the cage plates 21, 22 actually participate in centering the rotary gear 6. While in FIG. 14 two alternate roller configurations for rollers 41, 40 carried respectively by the lower and upper cage plates 21, 22 are in apparent alignment with each other, the central dividing line 42 in this figure has been inserted to indicate that this is not necessarily a single cross-section. FIG. 14 can represent a single cross-section, but can also represent a composite cross-section taken along different radial planes. According to this latter interpretation, the bottom roller 41 can actually correspond to rollers interspersed between top rollers 40 as shown in the upper half of the figure.

In FIG. 14 the upper roller 40 contacts the rotary gear 6 and the lower roller 41 is, according to this interpretation, exemplary of an adjacent upper roller (not shown) that contacts the edge face surface 16 of the top cover 2. The actually depicted upper roller 40 acts as a first centering guide between the rotary gear 6 and an associated upper cage plate 22; and the corresponding adjacent upper roller (not shown—that is exemplified by the lower roller 41) acts as a second centering guide between the upper cage plate 22 and the top cover 2. Thus such first and second centering guide portions, e.g. rollers 40, 41, extending respectively between a cage plate 22 and the rotary gear 6 and between a cage plate 22 and the edge face surface 16 of the associated cover. The general effect of this arrangement is that the cage plate 22 participates as part of the centering guide for the rotary gear 6.

While the rollers 40, 41 of FIG. 14 which constitute the first and second centering guide portions are shown as each being carried on a cage plate 22, 21, the cage plates 21, 22 may carry rollers 40 which exclusively contact the tong covers 2, 3 and the rotary gear 6 may carry rollers similar to rollers 15 that engage with a ledge or track formed on the cage plates 21, 22. In such case the first and second centering guide portions comprise rollers that are respectively carried on the cage plate and on the rotary gear.

As a further alternative, a tong can be built having only a second centering guide portion, e.g. a roller 41 carried by a cage plate 21. In this configuration a tong is provided wherein all of the rollers 40, 41 mounted in both the upper and lower cage plates 21, 22 are positioned according to the position of the lower roller 41 shown in FIG. 14. The support for the rotary gear 6 passes, not through the cage plate 21, 22, but through rollers 41 held by the cage plate 21. The same rollers 41 may contact both the edge face 16 of the cover plate 3 and a shoulder 43 on the rotary gear 6, optionally sliding on one of them.

Confinement of Rotary Gear Against Vertical Displacement

Figure 3:
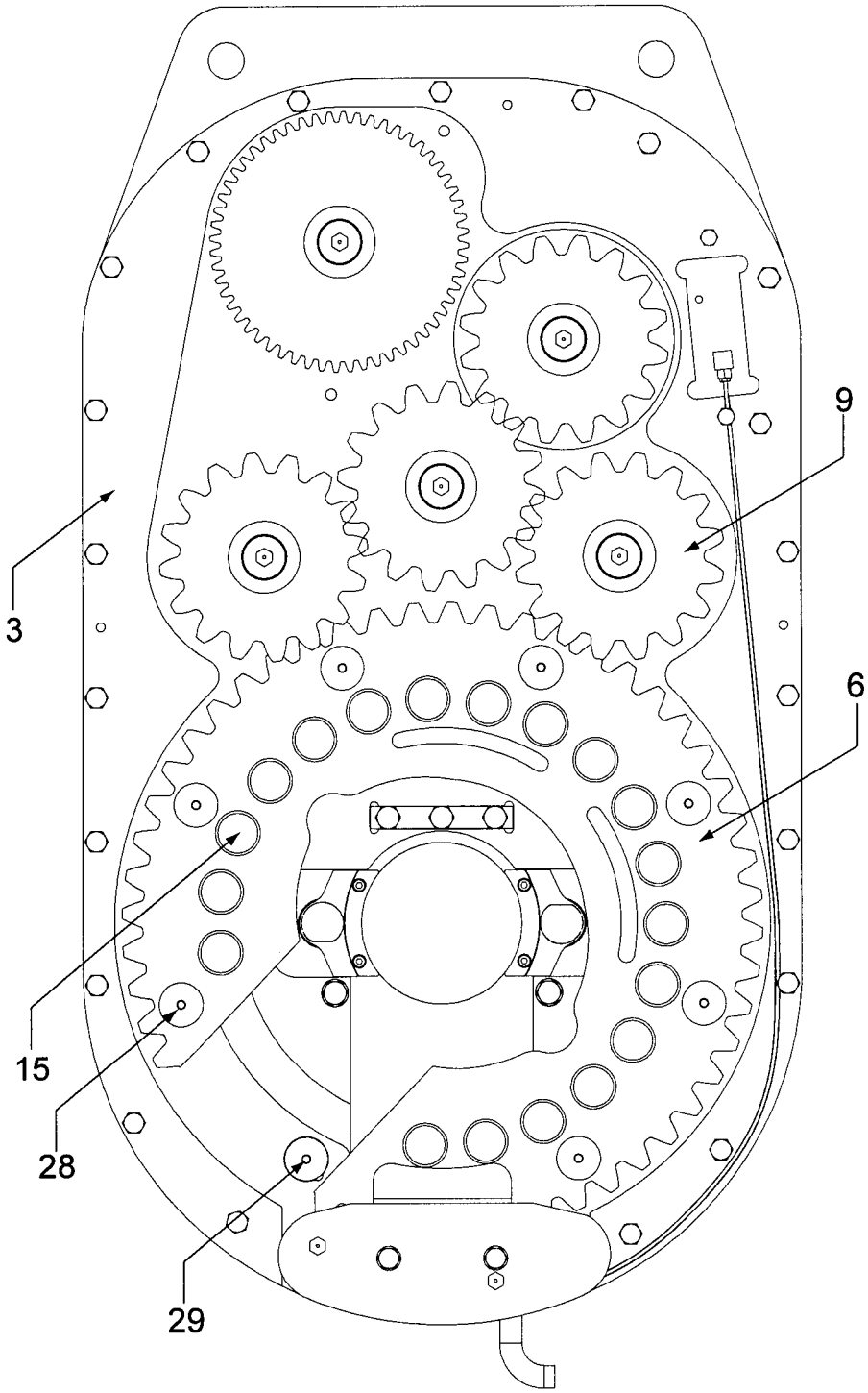
FIG. 3 is a plan view of the power tong as in FIG. 2 with the rotary gear partially rotated with respect to the tong body from the position of FIG. 2.
Figure 12:
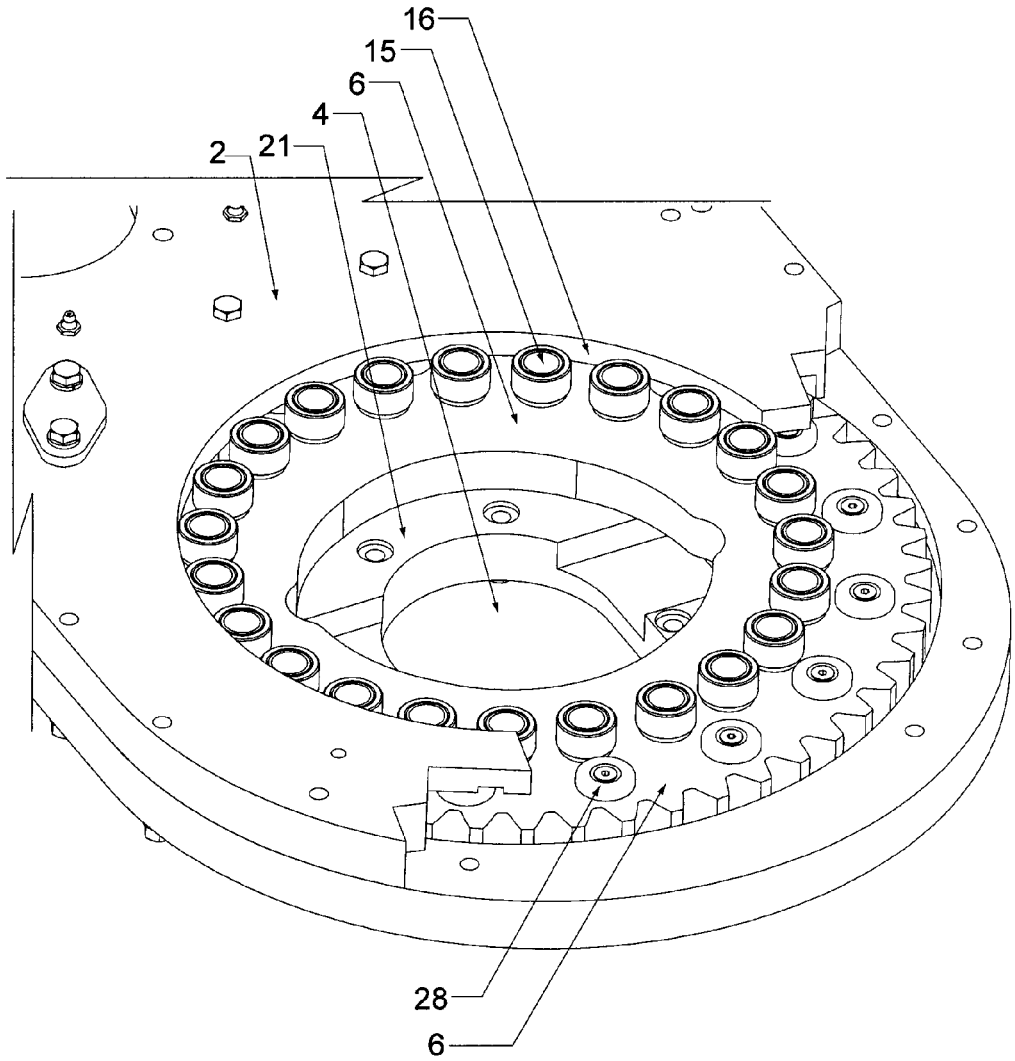
FIG. 12 is a perspective view of a closed throat variant of the power tong according to the invention with the top tong body cover shown in partial cross-section, thereby showing the rotary gear with cylindrical rollers and low friction bearing support buttons.
Figure 13:
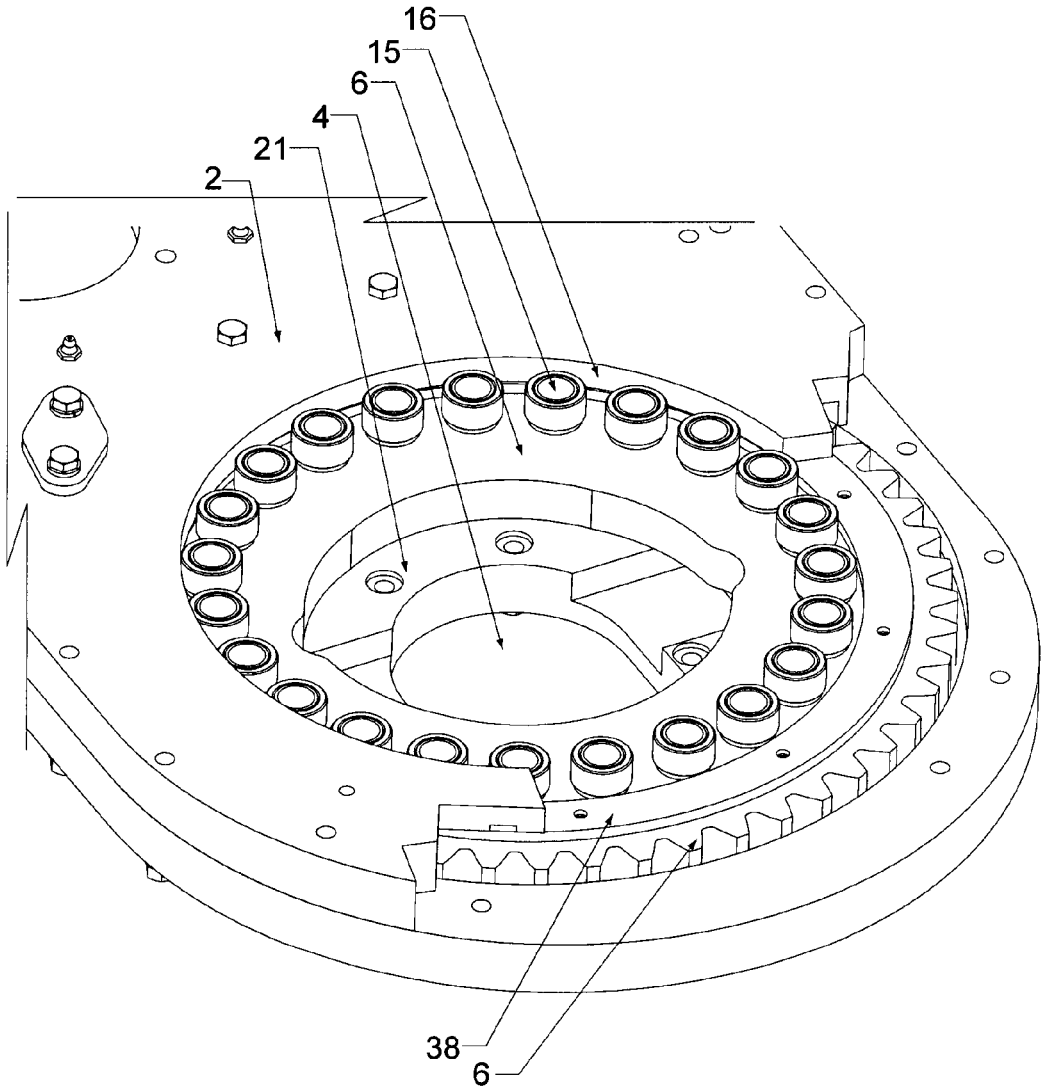
FIG. 13 is a view of an alternate variant on FIG. 12 where a continuous vertical deflection support ring is provided as an alternative to the low friction bearing support buttons.

To confine the rotary gear 6 against vertical displacement within the tong body 1, multiple low friction, bearing support "buttons" 28 are attached to the outer top side surfaces of the rotary gear 6 as shown in FIGS. 3, 12 and 14. These buttons 28 bear against a complementary surface formed on the inner underside surface of the upper cover plate 2. A similar mirror image arrangement is present on the underside of the rotary gear 6.

Two alternate arrangements are shown in FIGS. 3 and 14 wherein cover-mounted support buttons 29 are positioned on the inner face of the lower tong cover 2 to bear against a complementary surface formed on the underside surface of the rotary gear 6. On the top side of the rotary gear 6 buttons are carried by the gear 6 and the complementary face surface is formed on the underside surface of the upper tong cover 2. While both rotary gear-mounted and cover-mounted buttons 28, 29 are both shown in FIG. 3, one of either of these alternatives may be employed exclusively to confine the rotary gear 6 against vertical displacement on both its upper and lower faces.

Gate Latch Mechanism

In order to either latch the gate on a "C"-shaped power tong, or provide a detection mechanism to detect whether or not the gate is latched, such latching of the gate or latch status detection can be effected by a remote actuator or sensor connected to the gate through a push cable that is confined laterally so that it can be retracted or advanced along its length to apply a force or effect a displacement at a distance. While described as a "push cable", such a cable can optionally transmit a force in both directions, providing a push, pull function.

An example of one cable arrangement to achieve this effect is that of "Bowden cable". Bowden cable, invented by and named after Ernest Monnington Bowden (1860 to 1904) relies on an inner flexible cable, the "push cable", confined within an outer flexible sheath. As an alternative to the use of such cable, lateral confinement of a push cable within the power tong according to the invention is achieved by machining a confining groove of appropriate dimension into the inner surface of one of the tong body covers. The side walls of this groove then serve the function of the outer sheath utilized in Bowden cable. Preferably, a surface provided by the other cover also provides confinement.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A power tong for rotating pipe with a tong body having upper and lower tong body covers with a central opening formed in each such covers to receive pipe, said tong including a rotary gear with upper and lower faces contained between such covers wherein, in order to maintain alignment of the rotary gear relative to the tong body, on at least one side of the rotary gear the rotary gear is provided with support in the form of a centering guide for the rotary gear which extends between the rotary gear and a tong cover, passing entirely through the central opening formed in the tong cover, such centering guide comprising a contacting surface that permits differential rotational motion between the rotary gear and the tong cover.

2. A power tong as in claim 1 wherein the contacting surface comprises a radially inwardly directed contacting surface carried by the tong cover around or proximate to the perimeter of the central opening.

3. A power tong as in claim 2 wherein the inwardly directed contacting surface is provided by a guide rail surface fastened to the outside surface of the associated cover around the perimeter of the central opening.

4. A power tong as in claim 2 wherein said central opening in the cover has respective upper and lower edges and an inwardly directed edge face surface which provides the inwardly directed contacting surface.

5. A power tong as in claim 4 in combination with a cage plate wherein the cage plate is centered relative to the tong body by a cage plate centering guide which extends between the cage plate and the inwardly directed edge face surface bounding the central opening in the tong.

6. A power tong as in any one of claims 2, 3 or 4, wherein the rotary gear comprises rollers mounted thereon which bear against the inwardly directed contacting surface.

7. A power tong as in claim 1 in combination with a cage plate wherein a portion of the centering guide for the rotary gear provides centering support for the cage plate while permitting relative rotation of the cage plate with respect to the rotary gear.

8. A power tong as in claim 7 wherein the centering guide for the rotary gear comprises rollers mounted on the rotary gear and portions of such rollers which contact and provide centering support for the cage.

9. A power tong as in claim 1 in combination with a cage plate wherein the cage plate is centered relative to the tong body by a cage plate centering guide which extends between the cage plate and the tong cover.

10. A power tong as in claim 1 in combination with a cage plate wherein the centering guide comprises first and second centering guide portions, the first centering guide portion being provided between the tong cover and the cage plate; and the second centering guide portion being provided between the cage plate and the rotary gear wherein the cage plate carries the first centering guide portion that bears against the tong cover.

11. A power tong as in claim 10 wherein the first and second centering guide portions comprise rollers that are respectively carried on the cage plate and on the rotary gear.

12. A power tong as in claim 1 in combination with a cage plate wherein the centering guide comprises first and second centering guide portions, the first centering guide portion being provided between the tong cover and the cage plate, and the second centering guide portion being provided between the cage plate and the rotary gear wherein the cage plate carries both the first and second centering guide portions.

13. A power tong as in claim 12 wherein the rollers that constitute the first and second centering guide portions that are carried on the cage plate are interspersed between each other and respectively positioned to bear against the contacting surface carried by the tong cover and a rotary gear contacting surface present on the rotary gear.

14. A power tong as in claim 1 wherein the tong body is a "C"-shaped tong body having a throat and further comprising a gate for closing the throat, the gate comprising a track for engagement with portions of the centering guide and wherein the track is aligned with the contacting surface for the centering guide that is carried by the corresponding cover of the tong body when the gate is in a closed position.

15. A power tong as in claim 1 comprising a plurality of bearing buttons each with a friction reducing contacting face surface fitted respectively between the rotary gear and an associated tong cover, such bearing buttons being mounted onto either one or the other of the inside surface of the associated tong body cover or an outwardly directed surface of the rotary gear at locations opposite complementary face surfaces on the other of the associated tong body cover or rotary gear surface in order to accommodate the rotary gear in respect of vertical displacement within the tong body.

16. In a "C"-shaped power tong as in claim 1 having upper and lower tong body covers with outer and inner surfaces and a gate with a latch, a connection linkage extending between the latch and a latch actuator or a latch status detector located on the power tong remotely from the gate, the connection linkage comprising a push cable that is confined laterally so that it can be retracted or advanced along its length and apply a force or effect a displacement at a distance, wherein lateral confinement of the push cable is provided by a confining groove formed in the inner surface of one of the tong body covers.

17. A power tong as in claim 1 wherein the centering guide for the rotary gear is present on both sides of the rotary gear extending from a respective tong cover to the rotary gear to provide symmetrical centering support for both sides of the rotary gear.

* * * * *